US006705270B1

(12) United States Patent
Rau et al.

(10) Patent No.: US 6,705,270 B1
(45) Date of Patent: Mar. 16, 2004

(54) OIL PAN MODULE FOR INTERNAL COMBUSTION ENGINES

(75) Inventors: Walter Rau, Mannheim (DE); Scott Schlicker, Ferndale, MI (US); Ray Ballou, Livonia, MI (US); Eric Sattler, Trenton, MI (US); Douglas Shearin, Madison Heights, MI (US)

(73) Assignee: BASF Corporation, Mt. Olive, NJ (US)

( * ) Notice: Subject to any disclaimer, the term of this patent is extended or adjusted under 35 U.S.C. 154(b) by 0 days.

(21) Appl. No.: 09/558,678

(22) Filed: Apr. 26, 2000

(51) Int. Cl.[7] ..... F02F 7/00
(52) U.S. Cl. ..... 123/195 C; 184/106
(58) Field of Search ..... 123/195 C; 184/106

(56) References Cited

U.S. PATENT DOCUMENTS

| | | | | |
|---|---|---|---|---|
| 1,365,438 A | | 1/1921 | Adamson | |
| 4,848,293 A | * | 7/1989 | Sasada et al. | 123/195 C |
| 4,898,261 A | | 2/1990 | Winberg et al. | |
| 4,930,469 A | | 6/1990 | Kamprath et al. | |
| 4,938,184 A | * | 7/1990 | Martin et al. | 123/195 C |
| 5,863,424 A | * | 1/1999 | Lee | 210/168 |
| 6,058,898 A | * | 5/2000 | Freese, V | 123/195 C |
| 6,217,758 B1 | * | 4/2001 | Lee | 210/168 |

FOREIGN PATENT DOCUMENTS

| | | | | |
|---|---|---|---|---|
| DE | 8323945.6 | | 12/1983 | |
| DE | 3606052 | | 7/1986 | |
| EP | 942155 | | 9/1999 | |
| EP | 1041253 | | 10/2000 | |
| FR | 2760042 | | 8/1998 | |
| JP | 58119912 A | * | 7/1983 | 184/1.5 |
| JP | 63289064 A | * | 11/1988 | C08L/77/00 |

* cited by examiner

*Primary Examiner*—Noah P. Kamen
(74) *Attorney, Agent, or Firm*—Fernando A. Borrego

(57) ABSTRACT

The invention relates to an oil pan module (21) for internal combustion engines (1) and to a process for making such a part by injection molding. The oil pan module (21) is fastened to the housing (2) of the internal combustion engine (1) and holds the lubricating oil supply (7). Integrated with oil pan module (21) are parts (8, 9, 12) of the oil circulation system. Oil pan module (21) consists of a polyamide-based thermoplastic material reinforced with glass fibers and/or mineral matter.

5 Claims, 3 Drawing Sheets

OIL PAN MODULE FOR INTERNAL COMBUSTION ENGINES

BACKGROUND OF THE INVENTION

The invention relates to an oil pan module for internal combustion engines, for example those used for driving motor vehicles.

Oil pans used for internal combustion engines that drive motor vehicles are subject, first of all, to high sealing requirements that must be satisfied over the entire service life of the oil pan. During their entire service life, oil pans must resists all anticipated mechanical and thermal stresses over a wide temperature range. The operation of the internal combustion engine heats up the oil pan rapidly from two-digit subfreezing outdoor temperatures to temperatures in the range of about 130° C.; hence, the oil pan must be able to withstand the mechanical strains caused by such heat-up.

Moreover, oil pans must also possess corrosion resistance and be resistant to chemical attack by all media commonly encountered in the motor vehicle field. This, first of all, means hot motor oil. Motor oil that has already been used in the internal combustion engine for an extended length of time can attain a pH of 4.5 which is in the acidic range. Other corrosive stresses arise from possible contact with media such as fuel, brake fluid, superheated steam used for engine washing, as well as salt on the outside of the oil pan. The requirements placed on the oil pan component can be found in the specifications supplied by motor vehicle manufacturers. They include, for example, a heat resistance of −40° C. to +150° C., ability to withstand a continuous heat load of 130° C. and resistance to oils, fuels, cold cleaners, salt water and cooling water. Also required is mechanical resistance to common engine vibrations taking into account the fastening screws and the fact that the engine is disposed above the oil pan. The weight of the engine plus the drive train can reach up to 1700 kg. It is required that the fastening points be constructed of an appropriate plastic material and that the sealing element be integrated for certain uses, for example for use of oil pans in trucks, said sealing element being required to last 1 million kilometers assuming simultaneous aging resistance of the construction material used below the sealing element and the absence of condensation phenomena. The oil pans of passenger vehicles must also be resistant to impact stresses encountered when the vehicle passes over a curbstone.

These requirements are met by oil pans made of sheet metal or die-cast aluminum. Also known are hybrid oil pans in which the actual oil pan consists of a thermoplastic polymer reinforced by metallic or plastic elements to increase its mechanical strength. Such an oil pan is known from European Patent EP-0 952 513 A2. In this case, an outer layer of a metallic grid, particularly one made of light-weight metal, or of a plastic with similar strength characteristics is combined with a thin-walled shell.

EP 0 872 632 A1 discloses an oil pan for internal combustion engines which is disposed beneath the crankcase. The oil pan has a double wall consisting of an inner and an outer shell made of thermoplastic polymer, the outer shell being disposed in the lower part of the oil pan and ribs being provided between the inner and the outer shell, said ribs being molded onto the inner and/or outer shell and their height and separation being determined by locally prevailing stress conditions. The inner and outer shell are joined to each other by an appropriate joining method.

German patent DE 197 35 445 C2 discloses a plastic oil pan for engines or gears and which comprises an integrated suction and/or pressure oil filtration, The oil filter medium is disposed in the oil pan, and part of the oil pan forms the bottom of an oil filter housing. The plastic half-shell forms a cover for the oil filter housing, the oil filter medium being held between the oil pan and the plastic half-shell.

DE 196 44 645 A1 discloses an oil pan for an internal combustion engine in which the oil pan is designed as a multifunction component. Integral with the oil pan are an oil pump, an oil filter accessible from the outside, an oil-water heat exchanger, temperature controller, oil dipstick attachment, oil filling tube and possibly even a crankcase venting valve.

Considering the described prior art, the object of the invention is to extend the functionality of plastic engine components used to replace engine components made of metal.

BRIEF SUMMARY OF THE INVENTION

According to the invention, this objective is reached by making the oil pan module out of a thermoplastic polyamide-based polymer reinforced with fillers, such as glass fibers and/or mineral matter.

According to the invention, an oil pan of this type is fabricated by a one-component or multicomponent injection-molding process in which polyamide-based thermoplastic materials are used.

The oil pan module can be made of a high-impact polyamide. Depending on requirements placed on the oil pan module, which are stated, for example, in the specifications of an automobile manufacturer, the oil pan module can be reinforced by incorporating into the thermoplastic material fillers such as glass fibers or mineral matter.

In another embodiment of the invention, a metallic surge sheet in the form of an insert is integrated into the oil pan module of the invention. The surge sheet can be connected to the oil pan module by means of appropriate fasteners such as screws or snaps, and together with said module is fastened to the internal combustion engine beneath the crankcase. To increase the mechanical stability of the oil pan module and to stiffen it, said module is provided with external ribs injection-molded onto it, and on its inside, which holds the lubricant supply, with longitudinal and transverse dividers. This has a favorable effect on the mechanical strength and vibration characteristics of the oil pan module of the invention and results in more uniform temperature distribution so that strains in this component induced by nonuniform heating are prevented.

Integrated with the oil pan module is an electric oil pump disposed parallel to an oil-lifting line. By means of an electric connection provided on the outside of the oil pan module, said oil pump can be connected with and supplied by the electrical system of a motor vehicle (12-volt network). Besides the electric oil pump, a suction fitting extends into the oil pan module. Above the floor of the oil pan module, the suction fitting is closed by a screen-like insert. Through this insert, the lubricant supply 7 held in oil pan module 21 is aspirated. The cross-sectional surface area of the suction fitting can vary, namely it can decrease continuously in the direction of the suction side of the oil pump.

According to the process for fabricating an oil pan module, which is also disclosed as part of the invention, said oil pan module can be made of a thermoplastic material as an injection-molded part using a one-component or multicomponent injection-molding process. An oil pan module fabricated in this manner is provided with outer and inner reinforcing ribs injection-molded to it. The oil filter housing, sealing surfaces, reinforcing ribs and suction fitting can be integral with the oil pan module.

In a preferred process, the oil pan module is made of PA 6 or PA 66[1]. This thermoplastic material contains glass fibers or mineral matter as fillers. By means of this material, the mechanical strength of the oil pan module is increased considerably, making it possible to meet special customer requirements concerning the strength of the plastic injection-molded oil pan. Another suitable thermoplastic material for injection-molding the oil pan module of the invention is high-impact polyamide.

[1] PA=polyamide; PA 6=poly-caprolactam; PA 66=poly(1.6-hexamethylene adioamide×Translator The invention will now be explained in greater detail by way of the drawings in which

BRIEF DESCRIPTION OF THE SEVERAL VIEWS OF THE DRAWINGS

FIG. 1 is a side view partly broken away to show an internal combustion engine, its oil circulation system being indicated by arrows.

DETAILED DESCRIPTION OF THE INVENTION

Figure 1:
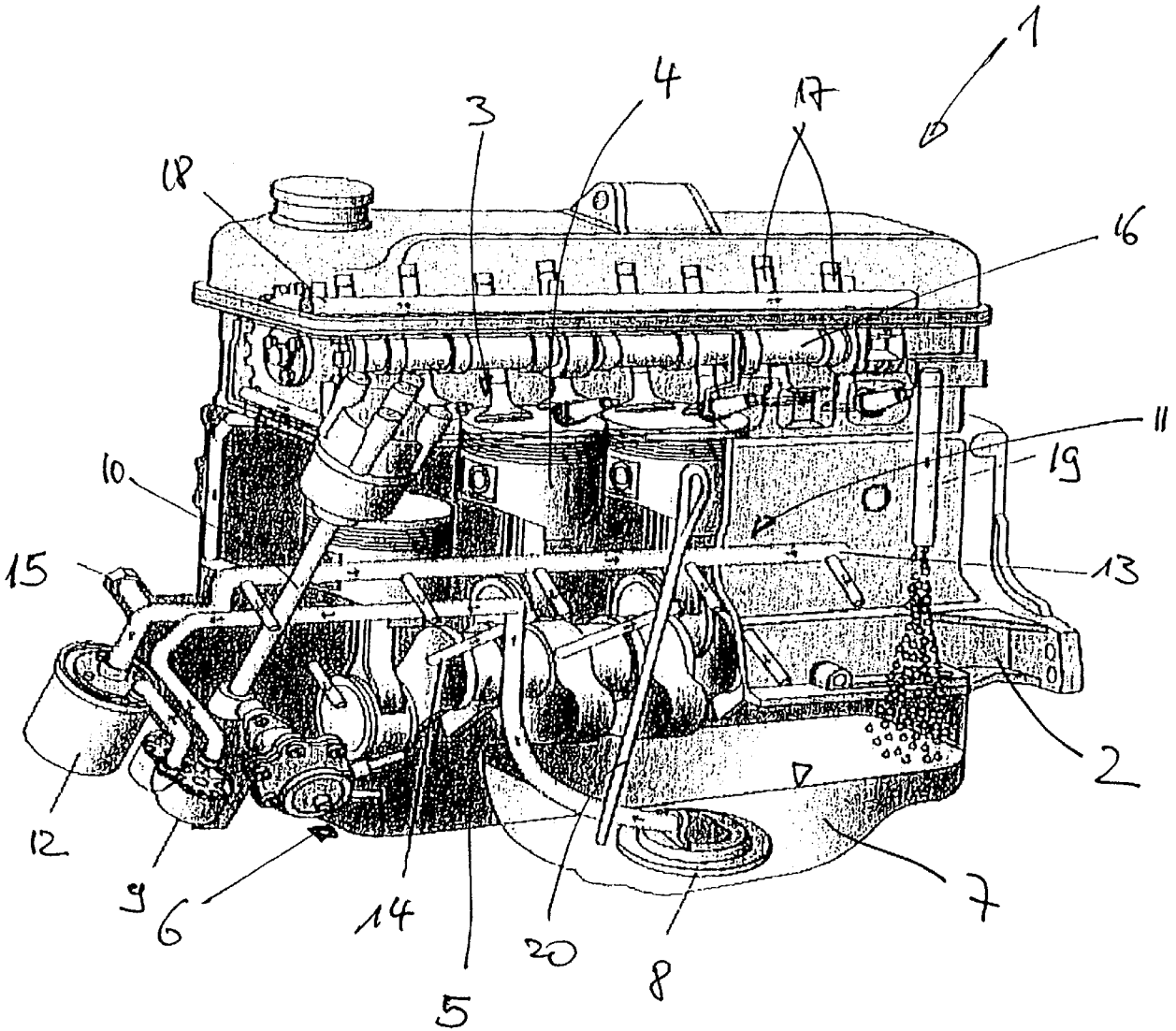
FIG. 1 is a side view partly broken away to show an internal combustion engine with oil circulation components.

Internal combustion engine 1 comprises an engine housing 2 sheltering the individual cylinders 3 in which individual pistons 4 move up and down. The connecting rods of pistons 4, which move up and down in the individual cylinders 3, connect with crankshaft 5 which is bent at right angles at several places. Crankshaft 5 is supported by crankshaft bearings integrated into engine housing 2, said bearings also being tied into lubricant circulation system 11.

Figure 2:
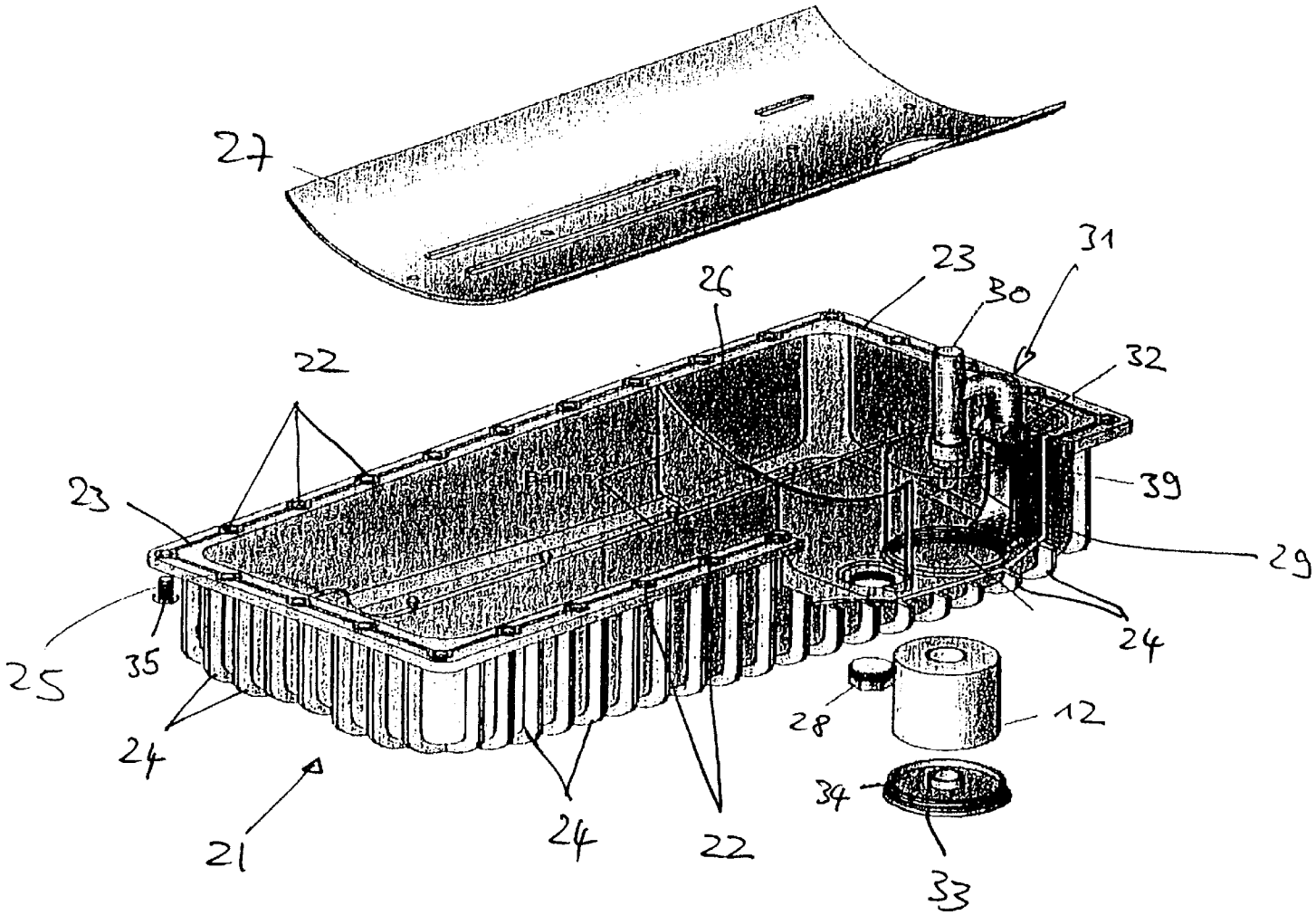
FIG. 2 shows the integration of a surge sheet on a rib inside the oil pan housing.
Figure 3:
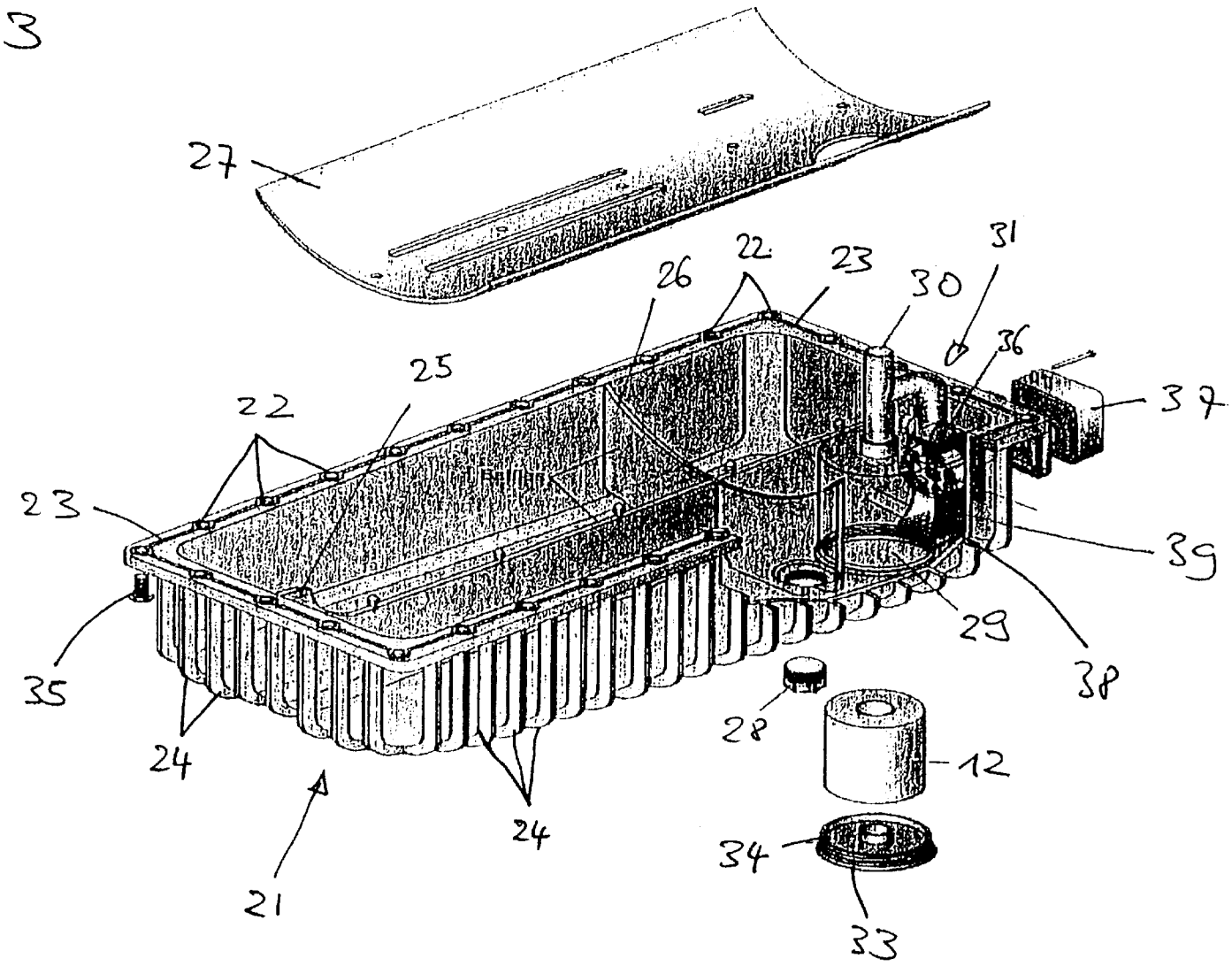
FIG. 3 shows an injection-molded oil pan module with inner and outer ribs, surge sheet and suction fitting for an electric oil pump.

Engine housing 2 holds lubricant supply 7 which is enclosed by oil pan module 21 (cf. FIGS. 2 and 3). From here, lubricant supply 7 is aspirated via suction fitting 8 and through a lifting line reaches the suction side of oil pump 9 which is driven by the engine. From the pressure side of said pump, the lubricant is pumped through oil filter 12 and arrives in a main oil line 13 for supplying the crankshaft bearing of crankshaft 5. From the main oil line 13 branch off several branch lines 14 which supply other engine components with oil. In the main oil line 13—viewed in the direction of flow—is provided a venting valve 15 which is located immediately behind oil filter 12. From here, main oil line 13 runs along motor housing 2. In the upper part of internal combustion engine 1 is represented a camshaft 16 supported on its two sides by the faces of engine housing 2. Camshaft 16 has its own oil line 18 which is supplied with lubricant from main oil line 13. Behind camshaft 16 are shown valve lifters 17 which bring about the gas exchange in the individual cylinders 3 of internal combustion engine 1. Reference numeral 19 identifies the oil circulation whereby the lubricating oil returns to oil pan 21 which is flange-mounted under crankcase 6 (cf. FIGS. 2 and 3).

On the long side of engine housing 2 is provided oil dipstick 20—here indicated only schematically—whereby it is possible to determine the level of lubricant supply 7 in the oil pan of internal combustion engine 1. Oil dipstick 20, which here is indicated only schematically, fits into a dipstick tube located on oil pan module 21, said tube forming an injection-molded part integral with oil pan module 21.

FIG. 2 shows an oil pan module into which is integrated a surge sheet and which comprises a subdivided inner space and ribs on the outside.

Oil pan module 21, which is injection-molded as a one-component or multicomponent plastic part, is provided on the fastening ridge with several holes 22, said ridge extending all around. Between the holes is provided sealing insert 23 with which oil pan module 21 abuts against the underside of crankcase 6 of internal combustion engine 1. A gasket extending all around is placed into sealing insert 23 before oil pan module 21 is screwed onto crankcase 6. Oil pan module 21 is screwed onto crankcase 6 with individual screws 35 which are inserted through individual holes 22 and are also enclosed by sealing insert 23.

Outside oil pan module 21 are located ribs 24 which, on the one hand, increase the mechanical stability of oil pan module 21 and, on the other, promote uniform temperature distribution in oil pan module 21. A uniform temperature distribution in oil pan model 21 reduces the build-up of heat-induced strain in said module thus contributing to a reduction in mechanical stress acting upon oil pan module 21. In the inner space of oil pan module 21 represented here are provided a longitudinal divider 25 and a transverse divider 26. On the one hand, said dividers contribute to a stiffening of oil pan module 21 and reduce the build-up of vibrations and thus noise development by the resonator represented by oil pan 21. On the other hand, longitudinal and transverse dividers 25 and 26 serve as supporting surfaces for an insert 27 having the form of a surge sheet. Depending on the configuration of oil pan module 21, said module can contain one or more transverse dividers 26 and also one or more longitudinal dividers 25 which are provided with openings and holes thus allowing the lubricant supply 7 to overflow. Depending on its intended use, insert 27 serving as surge sheet can have a number of openings for fastening various built-in parts, said number of openings being adapted to the degree of integration of oil pan module 21.

At the lowest point of the ribbed structure of oil pan module 21 is provided an oil discharge screw 28. Moreover, integral with oil pan module 21 is an oil filter housing 29 into which oil filter 12—accessible from the underside—can be introduced. The underside of oil filter housing 29 in oil pan module 21 is closed by a lid 33 containing ring seal 34. On the upper side of oil filter housing 29 is provided an oil-lifting line through which oil circulation system 11 on internal combustion engine 1 is supplied with lubricant. Next to the opening of filter housing 29 on the floor of oil pan module 21 is integrated suction fitting 39 through which the lubricant is aspirated, for example, by an electric or mechanical pump and after filtration is fed to oil-lifting line 30. Suction fitting 39 can be conical in shape with the cross-sectional surface area steadily declining from its aspiration opening above the floor of oil pan module 21 to a valve 32. In addition to having a rectangular or square shape, the cross-sectional configuration of suction fitting 39 can also be molded to have a round cross section.

Oil pan module 21 according to FIG. 2 is preferably made of a thermoplastic material, said thermoplastic material being oil-resistant. Suitable to this end are polyamide-based materials which allow the fabrication of plastic parts of even the most complicated geometry. The mechanical properties of the thermoplastic material, whose flowability in the injection mold can be favorably influenced by pre-heating and heating said mold, can be substantially adapted to and tailor-made for the intended use by the addition of fillers such as, for example, glass fiber materials or mineral matter. Particularly suitable materials are, for example, PA 6 or PA 66 which have outstanding resistance to lubricants, mechanical strength and, in particular, long-term performance. It is also conceivable to fabricate the injection-molded oil pan module 21 from some other polyamide-based material, for example from high-impact polyamide.

FIG. 3 shows the injection-molded plastic oil pan module 21 with ribs on the inside and outside, a surge sheet and an integrated suction fitting for an oil pump.

In this oil pan module 21, fabricated at a higher degree of integration, there is disposed above suction fitting 39 an electrically driven oil pump 36 which through a drive component 37 can be connected with the electric system of a motor vehicle (12–42 volt). By means of electric oil pump 36 and through a parallel branch line 31, the lubricant is pumped through oil filter 12 located in oil filter housing 29 before the oil filtered in this manner reaches oil circulation system 11 of internal combustion engine 1 through oil-lifting line 30.

At a lower degree of integration, it is possible to use a mechanically or electrically driven oil pump 36 that is not integrated with the oil pan housing. In this case, lubricant circulation system 11 operates through appropriate attached lines leading away from oil pan module 21.

Above the floor of oil pan module 21 is disposed a suction fitting 39 which on its underside can be provided with a filter screen 38 or some other filter insert. On the outside of oil pan module 21, there is provided an injection-molded surface to which drive component 37 can be fastened. Surge sheet 27, shown as an example, is provided with slit-shaped openings and round holes and is preferably made of the same material as oil pan module 21. Surge sheet or insert 27—supported by longitudinal divider 25 and transverse divider 26—can be fastened to oil pan module 21 by means of snaps or screws. In this manner, excessive local fluctuations of the lubricating oil level in oil pan module 21 can be prevented so that, on the average, the lubricant supply level is constant over the entire floor surface of oil pan module 21.

At the integration level according to FIG. 3, the longitudinal and transverse dividers 25 and 26 for mechanical stiffening, oil filter housing 29, suction fitting 39, electric oil pump 36 and oil lifting line 30 are integrated with oil pan module 21. This variant, too, provides an oil filter housing 29 containing oil filter 12 which is accessible from the outside.

Depending on the information provided by the vehicle manufacturer, the degree of integration of oil pan module 21 can be individually specified. The mechanical requirements placed on oil pan module 21 can be modified through the amount of fillers, such as glass fibers or mineral matter, incorporated into the thermoplastic material and can be adapted to the intended use. The number of longitudinal and transverse dividers 25, 26 for stiffening oil pan module 21 can be varied depending on the intended use. A dipstick tube for determining the level of lubricant supply in oil pan module 21 can also be injection-molded to the oil pan module 21 of the invention. Said dipstick tube is not shown in FIG. 3.

Oil pan module 21 can be fabricated by the one-component or multicomponent injection-molding process, whereby the molds are preferably heated, to be able reliably to produce even the most complicated geometries. Preferably, several injection points are provided on the molds to ensure uniform filling.

Listing of Reference Numerals

1 Internal combustion engine
2 Engine housing
3 Cylinder
4 Piston
5 Crankshaft
6 Crankcase
7 Lubricating oil supply
8 Suction filter
9 Driven oil pump
10 Drive shaft
11 Oil circulation system
12 Oil filter
13 Main oil line for crankshaft bearing
14 Branch line
15 Pressure-venting valve
16 Camshaft
17 Valve lifter
18 Oil line for camshaft
19 Oil return
20 Oil dipstick
21 Oil pan module
22 Hole
23 Seal insert
24 Ribs
25 Longitudinal divider
26 Transverse divider
27 Supporting surface
28 Oil discharge screw
29 Oil filter housing
30 Oil-lifting line
31 Parallel branch line
32 Valve
33 Lid
34 Gasket
35 Screw
36 Electric oil pump
37 Drive component
38 Filter insert
39 Suction fitting

What is claimed is:

1. Oil pan module for internal combustion engines (1) which is fastened to a housing (2) and holds a lubricating oil supply (7), and into which oil pan module (21) is integrated an electric oil pump (36) disposed in a parallel branch line (31) running parallel to an oil-lifting line (30), wherein said oil pan module (21) is composed of a polyamide-based thermoplastic material reinforced with glass fibers and/or mineral matter.

2. Oil pan module according to claim 1, characterized in that the thermoplastic material is a high-impact polyamide material.

3. Oil pan module according to claim 1, characterized in that into said module there is integrated a surge sheet (27) which is connected with oil pan module (21) by means of snaps or screws.

4. Oil pan module according to claim 1, characterized in that oil pan module (21) is provided with external ribs (24) and at least one longitudinal divider and at least one transverse divider (25, 26).

5. Oil pan module according to claim 1, wherein in oil pan module (21) there is provided beneath the integrated oil pump (36) a suction fitting contained in a filter insert (38).

* * * * *